US012552502B2

(12) United States Patent
Zou et al.

(10) Patent No.: US 12,552,502 B2
(45) Date of Patent: Feb. 17, 2026

(54) SELF-RIGHTING UNDERWATER ESCAPE AND SURFACE SURVIVAL SUIT SYSTEM

(71) Applicant: Mustang Survival Corp., Burnaby (CA)

(72) Inventors: Linbo Zou, Richmond (CA); Wendell Vaughn Uglene, Burnaby (CA)

(73) Assignee: Mustang Survival Corp., Burnaby (CA)

( * ) Notice: Subject to any disclaimer, the term of this patent is extended or adjusted under 35 U.S.C. 154(b) by 1219 days.

(21) Appl. No.: 17/323,202

(22) Filed: May 18, 2021

(65) Prior Publication Data

US 2022/0371707 A1 Nov. 24, 2022

(51) Int. Cl.
*B63C 9/105* (2006.01)

(52) U.S. Cl.
CPC ..... *B63C 9/1055* (2013.01)

(58) Field of Classification Search
CPC ..... B63C 9/00; B63C 9/1055; B63C 9/087; B63C 2011/02; B63C 2011/04; B63C 2011/043
See application file for complete search history.

(56) References Cited

U.S. PATENT DOCUMENTS 2,084,520 A * 6/1937 Clifford ..... B63C 11/24 128/201.27
2,761,154 A * 9/1956 Horiuchi ..... B63C 9/1055 441/104
4,569,082 A 2/1986 Ainsworth et al.
6,976,894 B1 12/2005 Turner
7,900,573 B2 3/2011 Prendergast et al.
8,006,317 B2 8/2011 Taylor et al.
8,032,945 B2 10/2011 Taylor et al.
8,092,267 B2 1/2012 Taylor et al.
2004/0074799 A1* 4/2004 Bell ..... B65D 75/66 206/459.1
2004/0237178 A1 12/2004 Landeros
2006/0073749 A1* 4/2006 Turner ..... B63C 9/1055 441/103
2009/0139440 A1* 6/2009 Prendergast ..... B63C 9/1055 114/336
2009/0313747 A1* 12/2009 Taylor ..... B63C 9/1055 2/456

FOREIGN PATENT DOCUMENTS

DE 102011008874 A1 * 7/2012 ..... B63G 8/40
EP 0444400 A1 * 9/1991 ..... B63C 9/065
EP 0444400 B9 9/1991
GB 2330517 B 4/1999

* cited by examiner

*Primary Examiner* — Kendra D Carter
*Assistant Examiner* — Maap Ellabib
(74) *Attorney, Agent, or Firm* — Taft Stettinius & Hollister LLP

(57) ABSTRACT

A self-righting underwater escape and surface survival suit includes an ascent hood and an inflatable bladder in fluid communication with the ascent hood. Breathable air from the vessel is used to inflate the inflatable bladder for ascent to and/or survival on the water surface. During ascent, breathable air is provided to the ascent hood from the inflated inflatable bladder. The inflated inflatable bladder is configured to provide self-righting of the wearer upon surfacing and to support the wearer on the water surface, even if the wearer is incapacitated or the ascent hood is opened.

18 Claims, 5 Drawing Sheets

SELF-RIGHTING UNDERWATER ESCAPE AND SURFACE SURVIVAL SUIT SYSTEM

FIELD OF THE INVENTION

The present description relates to an underwater escape suit system with self-righting and surface survival capabilities.

BACKGROUND

Submarine escape suits can be stored in submarines and other vessels for use in the event an underwater evacuation is necessary. Submarine escape suits are typically configured to completely enclose the wearer's body and are connectable to an air supply of the submarine for inflation of an ascent stole to allow ascent of the wearer from the submerged submarine to the water surface. Such suits may also include an ascent hood that covers the head of the wearer and receives breathable air from the ascent stole during ascent. A liferaft may also be carried by the submarine escape suit for inflation after the wearer reaches the surface.

The ascent stole of prior submarine escape suits may not adequately support the wearer on the surface of the water. For example, the ascent stole may make it difficult for the wearer to right oneself at the surface, or may not be able to maintain sufficient buoyancy once the wearer surfaces. Some submarine escape suits provide a separate life preserver stole and air supply that is carried by the suit to inflate the life preserver stole once the wearer surfaces. However, the wearer may not be able to inflate the life preserver stole if unconscious or incapacitated, or if the gas supply carried by the suit is inoperable. The provision of an additional stole for a life preserver and the gas supply for inflation of the life preserver stole at the surface may also increase the volume of the suit to be packed for storage. Therefore, further improvements in this area are needed.

SUMMARY

A self-righting underwater escape and surface survival suit system is disclosed herein that includes an escape and survival suit with an ascent hood and an inflatable bladder that is inflated for buoyancy to ascend the wearer from the submerged vessel to the water surface. The inflatable bladder is inflated with the breathable air supply contained within the submerged vessel. The breathable air is provided from the inflated bladder to the ascent hood for use by the wearer during ascent to the water surface. The inflated bladder is configured to provide self-righting of the wearer at the surface while also providing sufficient buoyancy to support the wearer on the surface of the water, even if the wearer is incapacitated or the ascent hood is removed.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

The invention may best be understood by referring to the following description and accompanying drawings that are used to illustrate embodiments of the invention. In the drawings.

DETAILED DESCRIPTION

Figure 1:
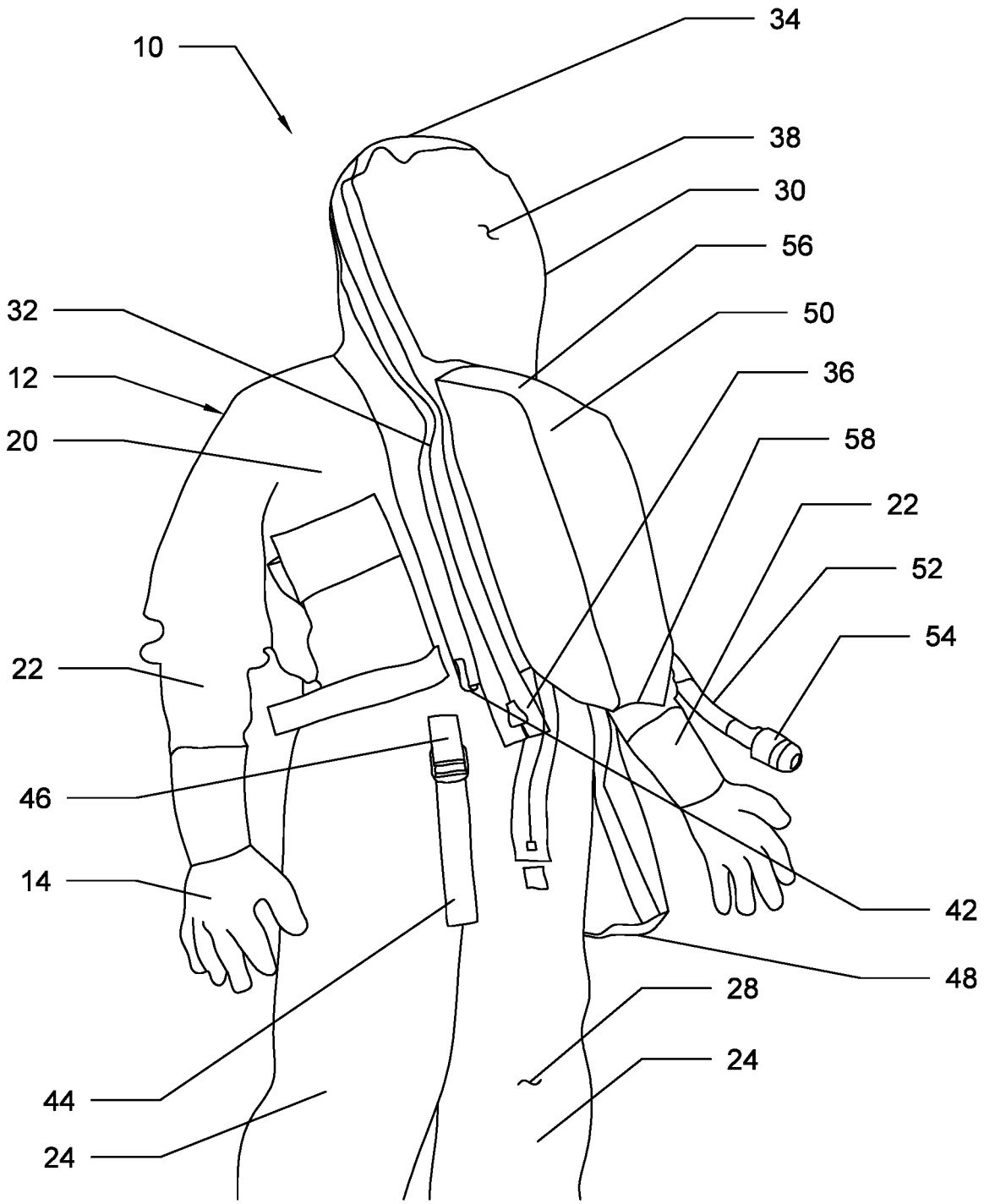
FIG. 1 is an isometric view of one embodiment of the self-righting underwater escape and surface survival suit system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Figure 2:
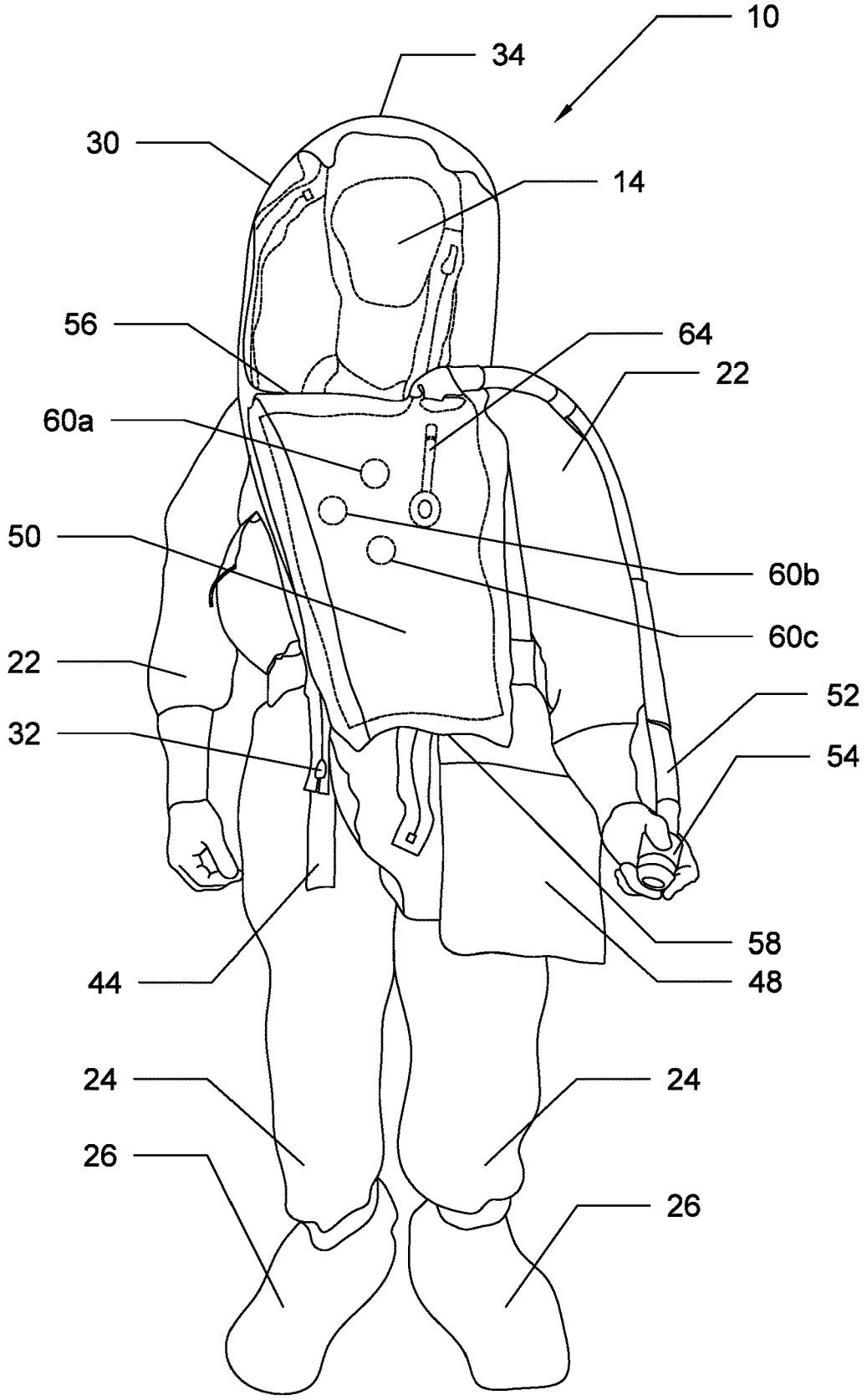
FIG. 2 is a front view of the escape and survival suit system of FIG. 1.
Figure 3:
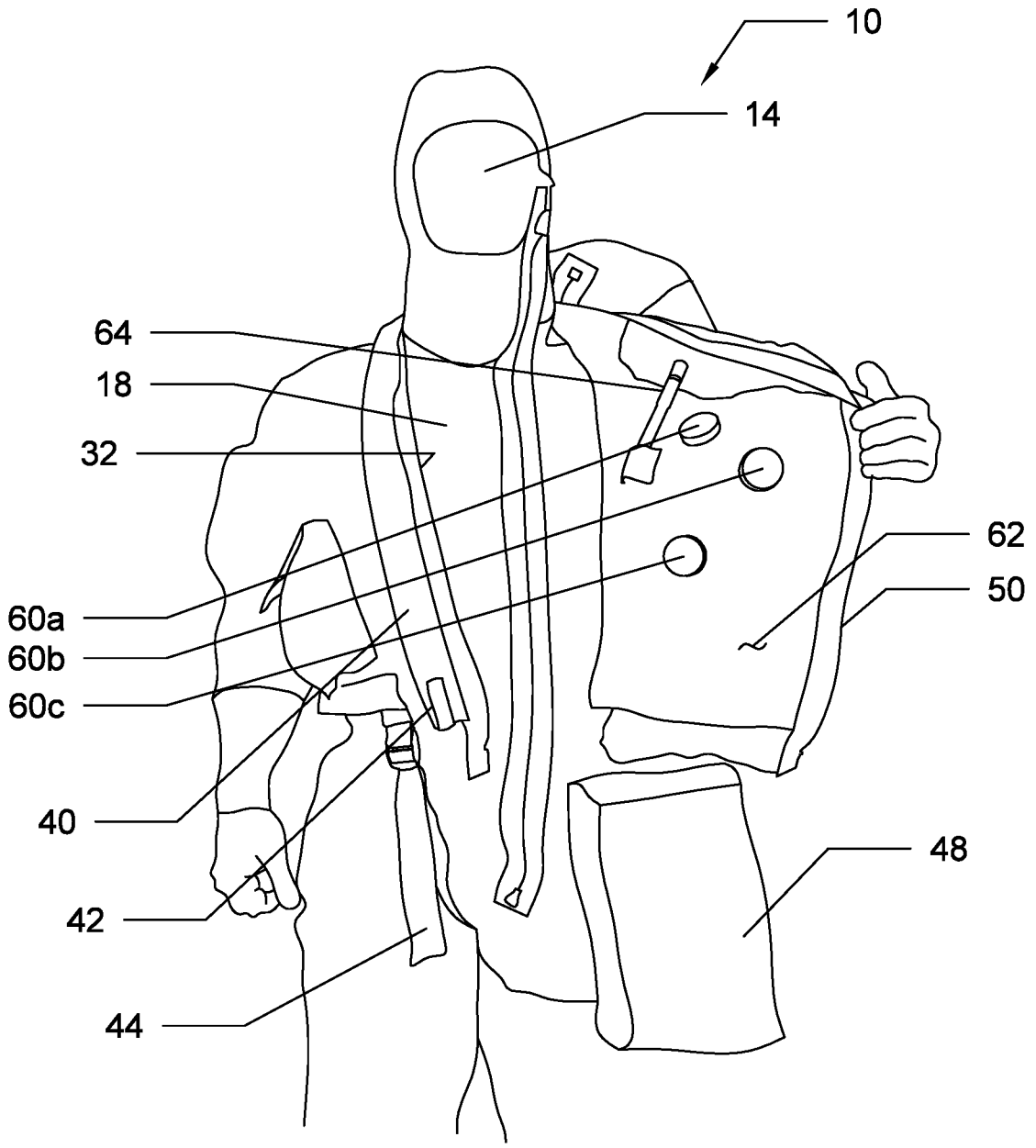
FIG. 3 is a front view of the escape and survival suit system of FIG. 1 with the ascent hood off and showing an inside view of the inflatable bladder.

FIGS. 1-3 show an embodiment of a self-righting underwater escape and surface survival suit system 10 that includes an escape and survival suit 12 for escaping a submerged vessel, such as a disabled submarine, although its use is not limited to submarine escape. The escape and survival suit 12 can, for example, be configured to cover all or a part of the body of the wearer 14. The wearer 14 may don a thermal undergarment 18 before donning the escape and survival suit 12. In the illustrated embodiment, the entire body of the wearer 14 is covered by the escape and survival suit 12. Self-righting underwater escape and surface survival suit system 10 can be folded and stored in a low volume arrangement in a vacuum pack (not shown) in the submarine, boat, or other vessel for access in the event an escape from the submerged vessel is necessary. However, the self-righting underwater escape and surface survival suit system 10 may also be used in situations where an underwater escape is not necessary, such as when escaping a vessel that is disabled or before sinking.

In one embodiment, escape and survival suit 12 includes one or more of a torso portion 20, arm portions 22, leg portions 24, and foot coverings 26, all or a portion of which are formed by waterproof material 28. Escape and survival suit 12 also includes an ascent hood 30 configured to enclose the head of the wearer 14, and an inflatable bladder 50 located on a front of the torso portion 20. Inflatable bladder 50 is connectable to a breathable air supply via conduit 52 extending along one of the arm portions 22 to an inflation valve 54. The inflation valve 54 is opened to allow the breathable air to flow into and inflate the inflatable bladder 50, and then closed so as to maintain inflation of the inflatable bladder 50 to provide buoyancy for ascent of the wearer 14 to the water surface.

Figure 4:
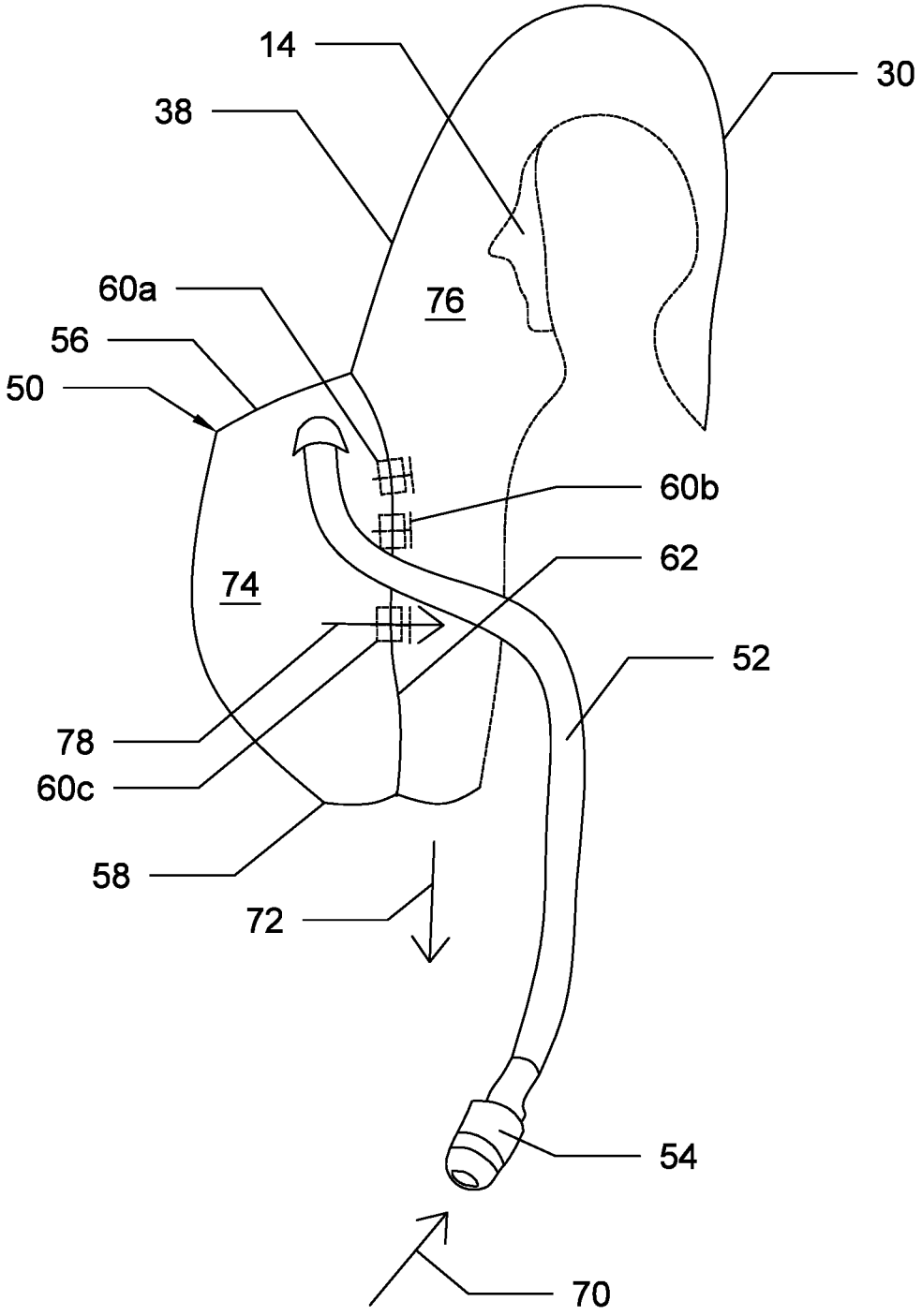
FIG. 4 is a side view of a portion of the escape and survival suit system of FIG. 1 with the inflatable bladder inflated.
Figure 5:
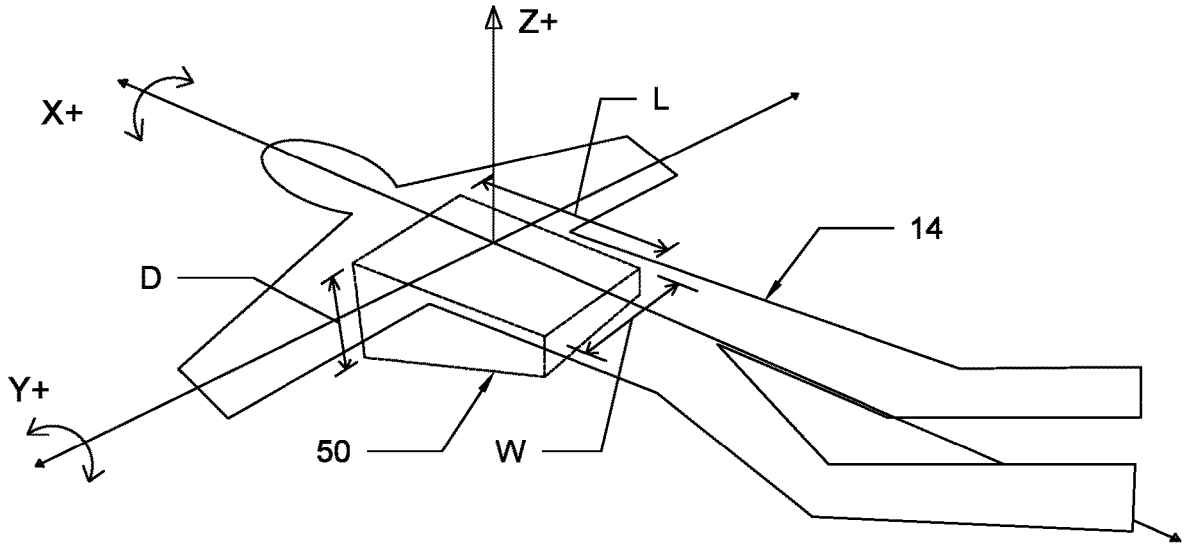
FIG. 5 is an isometric schematic diagram showing the orientation of the inflatable bladder on the wearer.

Referring further to FIGS. 4-5, inflatable bladder 50 includes a trapezoidal shape that tapers in width, depth, and/or volume in a direction away from ascent hood 30 toward leg portions 24. For example, as shown further in FIG. 5, inflatable bladder 50 includes a length L along the body of wearer 14 as indicated by axis X, a width W across the body of wearer 14 as indicated by axis Y, and depth D extending outwardly from the chest of wearer 14 as indicated by axis Z. Width W and/or depth D can taper to a smaller width and/or smaller depth in a downward direction (−) direction of the axis X, i.e. toward the feet of wearer 14.

The upper end 56 of inflatable bladder 50 is located below a visor 38 of ascent hood 30. The lower end 58 of inflatable bladder 50 is located at or near the belt line or waist of torso portion 20. The tapered or trapezoidal shaped volume of inflatable bladder 50 assists in orienting the head of wearer 14 upwardly, while the location of inflatable bladder 50 below the head and on the chest of the wearer 14 assists in maintaining the head of wearer 14 above the water surface. Inflatable bladder 50 may include a single air chamber that is inflated. Other embodiments contemplate multiple chambers within the inflatable bladder 50.

Inflation of inflatable bladder 50 provides sufficient buoyancy for the wearer 14 to ascend to the water surface. For example, as shown in FIG. 4, inflation air 70 is provided to inflatable bladder through inflation valve 54 via conduit 52. During and/or after ascent, air can be released via an air outlet 72 at lower end 58 of inflatable bladder 50. Once the water surface is reached, the inflated inflatable bladder 50 is able to self-right the wearer 14, if necessary, from a face down orientation to a face up orientation, even if the wearer 14 is unconscious or incapacitated, i.e. without intervention by the wearer 14. The inflated inflatable bladder 50 is also able to maintain sufficient buoyancy after ascent to keep the head of the wearer 14 above the water surface to reduce drowning risk.

In the illustrated embodiment, three air valves 60*a*, 60*b*, 60*c* (collectively referred to as air valves 60) are provided on an inner side wall 62 of inflatable bladder 50 that fluidly connect the interior air chamber 74 of inflatable bladder 50 to the interior 76 of ascent hood 30. Other embodiments contemplate that one, two, or four or more air valves 60 can be provided. Air valve(s) 60 automatically open in response to an air pressure exceeding a first threshold so that breathable air is provided to the interior of ascent hood 30 during ascent, as indicated by air flow 78, it being understood that all or a portion of air valves 60 can provide air flow 78. Air valve(s) 60 automatically close in response to an air pressure dropping below a second threshold air pressure that is less than the first threshold pressure so that inflatable bladder 50 remains inflated, even after the wearer 14 reaches the surface and/or ascent hood 30 is opened.

In one embodiment, the first threshold air pressure is 0.7 pounds per square inch (psi) plus or minus 0.1 psi. The second threshold air pressure is 0.5 psi plus or minus 0.1 psi. Other threshold pressures are also contemplated in other embodiments, so long as air valve(s) 60 automatically open to provide breathable air to pressurize the ascent hood 30 during ascent for a breathable air supply and to prevent or mitigate water intrusion into the ascent hood 30. In addition, the air valve(s) 60 should automatically close so sufficient pressure is maintained in inflatable bladder 50 after the wearer 14 reaches the surface to automatically self-right the wearer 14 and support the wearer 14 on the surface, even if the wearer is unconscious or incapacitated.

The escape and survival suit 12 may also include an inflation tube 64 extending into the ascent hood 30 that is connected to the inflatable bladder 50 at inner side wall 62. The wearer 14 can manually inflate the inflatable bladder 50 if desired by blowing air into the inflatable bladder 50 via the inflation tube 64.

Ascent hood 30 is attached to escape and survival suit 12 with a closure device 32 that extends from a top 34 of ascent hood 30, along one side of inflatable bladder 50, to a location 36 at or near the waist of torso portion 20. In one embodiment, the closure device 32 is a zipper. The closure device 32 is opened to allow the wearer 14 to enter the escape and survival suit 12, and then closed to enclose the wearer 14 in escape and survival suit 12 while providing a sufficient seal to allow the interior of ascent hood 30 to be pressurized with breathable air during ascent.

The ascent hood 30 includes a transparent visor 38 that overlies the face of the wearer 14. Since the closure device is offset to one side of ascent hood 30, the visor 38 is unobstructed to provide good visibility to the wearer 14 during and after ascent to the water surface. Once the wearer 14 reaches the water surface, the ascent hood 30 and/or visor 38 can be opened via a non-reclosable tear strip 40 located along closure device 32. The tear strip 40 includes a tab 42 that can readily grasped by the wearer 14 and pulled upwardly to allow the ascent hood 30 to be easily opened while the inflatable bladder 50 remains attached to escape and survival suit 12 over the chest of the wearer 14. This allows the wearer 14 to be able to breathe ambient air if desired once the water surface is reached.

The escape and survival suit 12 may also include an adjustment strap 44 that extends from a back of the escape and survival suit 12, through the crotch region, to a connection 46 at the front of escape and survival suit 12 near the torso portion 20. The adjustment strap 44 allows the wearer 14 to provide a more snug fit for torso portion 20 after donning the escape and survival suit 12.

The a self-righting underwater escape and surface survival system 10 may also include various life support aids attached to escape and survival suit 12 to assist in wearer survival. For example, a pouch 48 may include a liferaft that is inflated after the wearer reaches the water surface. Escape and survival suit 12 may include gloves and/or pockets or pouches 48, straps 44, buckles, etc. for attachment of various life support aids. Life support aids that may be attached to escape and survival suit 12 may include, for example, first aid kits, food, water, flares, tools, weapons, communication devices, etc.

Various aspects of the present disclosure are contemplated herein. One or more features of these aspects may be employed with any of the other aspects and features disclosed herein. For example, one aspect of the present disclosure is directed to an escape and survival suit that includes an ascent hood and an inflatable bladder in fluid communication with the ascent hood. The ascent hood is configured to cover a head of a wearer of the escape and survival suit. The inflatable bladder is inflated with breathable air and provides the breathable air to the ascent hood during ascent of the wearer a water surface. The inflated inflatable bladder is also configured to support and self-right the wearer upon reaching the water surface.

In an embodiment, a conduit extends along an arm of the escape and survival suit to an inflation valve at a terminal end of the conduit. The inflation valve is connectable to a source of breathable air on a vessel to inflate the inflatable bladder with breathable air from the vessel.

In an embodiment, at least one air valve fluidly connects the inflatable bladder to the ascent hood. The at least one air valve automatically opens at a first threshold pressure to supply breathable air from the inflated inflatable bladder to the ascent hood. In an embodiment, the at least one air valve automatically closes at a second threshold pressure that is less than the first threshold pressure. In an embodiment, the first threshold pressure is about 0.7 psi and the second threshold pressure is about 0.5 psi. In an embodiment, the automatic closing of the at least one air valve maintains inflation of the inflatable bladder. In an embodiment, the at least one air valve includes three air valves.

In an embodiment, an inflation tube extends into the ascent hood that is connected to the inflatable bladder. The wearer can manually inflate the inflatable bladder via the inflation tube. In an embodiment, the inflatable bladder is a single chamber air bladder.

In an embodiment, the inflatable bladder has a trapezoidal shape. In an embodiment, the trapezoidal shape tapers in a direction away from the ascent hood. In an embodiment, the inflatable bladder extends over a chest of the wearer to automatically self-right the wearer from a face-down position to a face-up position on the water surface.

In an embodiment, the breathable air provided from the inflatable bladder to the ascent hood pressurizes the ascent hood to mitigate water migration into the ascent hood during ascent. In an embodiment, means is provided for attaching one or more life support aids to the escape and survival suit. Such means can include pockets, pouches, straps, and buckles, for example.

In an embodiment, the ascent hood includes a face visor that overlies a face of the wearer, and the escape and survival suit includes a closure device for opening and closing the escape and survival suit that extends along one side of the ascent hood that is offset from the face visor so that the face visor is unobstructed. In an embodiment, the escape and survival suit includes a non-reclosable tear strip along one side of the ascent hood that can be torn by the wearer to open the ascent hood for access to ambient air in response to failure of the closure device.

Another aspect of the present disclosure includes an escape and survival suit that includes an ascent hood, an inflatable bladder, and at least one air valve connecting the ascent hood with the inflatable bladder. The ascent hood is configured to cover a head of a wearer of the escape and survival suit. The inflatable bladder is connectable to a breathable air supply on a vessel to inflate the inflatable bladder with breathable air for ascent of the wearer to a water surface. The at least one air valve automatically opens in response to a pressure in the inflated inflatable bladder exceeding a first threshold pressure to provide breathable air to the ascent hood during ascent. The least one air valve automatically closes in response to the pressure dropping below a second threshold pressure to maintain inflation of the inflated inflatable bladder at the water surface to support and self-right the wearer at the water surface.

In an embodiment, the inflatable bladder has a trapezoidal shape extending over a chest of the wearer that tapers in a direction away from the ascent hood. In an embodiment, the at least one air valve includes two or more air valves.

Another aspect of the present disclosure includes an escape and survival suit with an ascent hood configured to cover a head of a wearer of the escape and survival suit and an inflatable bladder in fluid communication with the ascent hood. The inflatable bladder is connectable to a breathable air supply on a vessel to inflate the inflatable bladder with breathable air. The inflatable bladder includes a trapezoidal shape that overlies a chest of the wearer when inflated to automatically self-right the wearer from a face-down position to a face-up position on the water surface.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An escape and survival suit, comprising: an ascent hood configured to cover a head of a wearer of the escape and survival suit; and an inflatable bladder in fluid communication with the ascent hood, wherein with the inflatable bladder inflated with breathable air, the inflated inflatable bladder provides buoyancy for ascent of the wearer to a water surface and provides the breathable air to the ascent hood during ascent of the wearer to the water surface, the inflated inflatable bladder also being configured to maintain sufficient pressure from the breathable air used to inflate the inflatable bladder for ascent to automatically support and self-right the wearer upon reaching the water surface; wherein the inflatable bladder has a trapezoidal shape that tapers in width, depth, and/or volume and is configured to overlay a chest of the wearer with a width across the chest of the wearer and a depth extending outwardly from the chest of the wearer that both taper in a direction away from the ascent hood to assist in orienting a head of the wearer upwardly and above the water surface.

2. The escape and survival suit of claim 1, further comprising a conduit extending along an arm of the escape and survival suit to an inflation valve at a terminal end of the conduit, wherein the inflation valve is connectable to a source of breathable air on a vessel to inflate the inflatable bladder with breathable air.

3. The escape and survival suit of claim 1, further comprising at least one air valve that fluidly connects the inflatable bladder to the ascent hood, wherein the at least one air valve automatically opens at a first threshold pressure to supply breathable air from the inflated inflatable bladder to the ascent hood.

4. The escape and survival suit of claim 3, wherein the at least one air valve automatically closes at a second threshold pressure that is less than the first threshold pressure.

5. The escape and survival suit of claim 4, wherein the first threshold pressure is about 0.7 psi and the second threshold pressure is about 0.5 psi.

6. The escape and survival suit of claim 4, wherein the automatic closing of the at least one air valve maintains inflation of the inflatable bladder.

7. The escape and survival suit of claim 3, wherein the at least one air valve includes three air valves.

8. The escape and survival suit of claim 1, further comprising an inflation tube extending into the ascent hood that is connected to the inflatable bladder, wherein the wearer can manually inflate the inflatable bladder via the inflation tube by blowing air into the inflatable bladder via the inflation tube.

9. The escape and survival suit of claim 1, wherein the inflatable bladder is a single chamber air bladder.

10. The escape and survival suit of claim 1, wherein the breathable air provided from the inflatable bladder to the ascent hood pressurizes the ascent hood to mitigate water migration into the ascent hood during ascent.

11. The escape and survival suit of claim 1, further comprising means for attaching one or more life support aids to the escape and survival suit.

12. The escape and survival suit of claim 1, wherein the ascent hood includes a face visor that overlies a face of the wearer, and the escape and survival suit includes a closure device for opening and closing the escape and survival suit that extends along one side of the ascent hood that is offset from the face visor so that the face visor is unobstructed.

13. The escape and survival suit of claim 12, wherein the escape and survival suit includes a non-reclosable tear strip along one side of the ascent hood that can be torn by the wearer to open the ascent hood for access to ambient air in response to failure of the closure device.

14. An escape and survival suit, comprising: an ascent hood configured to cover a head of a wearer of the escape and survival suit; an inflatable bladder connectable to a breathable air supply on a vessel to inflate the inflatable bladder with a breathable air to provide buoyancy for ascent of the wearer to a water surface; and at least one air valve connecting the inflatable bladder to the ascent hood so that the breathable air for the ascent hood is provided only through the inflatable bladder, wherein the at least one air valve automatically opens in response to a pressure in the inflated inflatable bladder exceeding a first threshold pressure to provide the breathable air to the ascent hood during ascent, the least one air valve automatically closing during the ascent in response to the pressure dropping below a second threshold pressure to maintain inflation of the inflated inflatable bladder with the breathable air used to inflate the inflatable bladder for ascent at the water surface to automatically support and self-right the wearer at the water surface; wherein the inflatable bladder has a trapezoidal shape that tapers in width, depth, and/or volume and is configured to overlay a chest of the wearer with a width across the chest of the wearer and a depth extending outwardly from the chest of the wearer that both taper in a direction away from the ascent hood to assist in orienting a head of the wearer upwardly and above the water surface.

15. The escape and survival suit of claim 14, wherein the at least one air valve includes two or more air valves.

16. An escape and survival suit, comprising: an ascent hood configured to cover a head of a wearer of the escape and survival suit; and an inflatable bladder in fluid communication with the ascent hood and connectable to a breathable air supply on a vessel to inflate the inflatable bladder with breathable air to provide buoyancy for ascent of the wearer to a water surface, wherein the inflatable bladder includes a trapezoidal shape that tapers in width, depth, and/or volume and is configured to overlay a chest of the wearer and having a width configured to extend across the chest of the wearer and a depth configured to extend outwardly from the chest of the wearer that both taper in a direction away from the ascent hood, the inflatable bladder configured to maintain sufficient pressure from the breathable air when inflated to automatically self-right the wearer from a face-down position to a face-up position on the water surface.

17. The escape and survival suit of claim 16, further comprising at least one air valve that fluidly connects the inflatable bladder to the ascent hood, wherein the at least one air valve automatically opens at a first threshold pressure to supply breathable air from the inflated inflatable bladder to the ascent hood and the at least one air valve automatically closes at a second threshold pressure that is less than the first threshold pressure.

18. The escape and survival suit of claim 14, further comprising an inflation tube extending into the ascent hood that is connected to the inflatable bladder, wherein the wearer can manually inflate the inflatable bladder via the inflation tube by blowing air into the inflatable bladder via the inflation tube.

* * * * *